US007789966B2

(12) United States Patent
Krämer et al.

(10) Patent No.: US 7,789,966 B2
(45) Date of Patent: Sep. 7, 2010

(54) METHOD FOR CLEANING THE PIPES OF A HEAT EXCHANGER BY USE OF AN ABRASIVE AND DEVICE SUITABLE FOR THIS METHOD

(75) Inventors: Georg Krämer, Wiesenttal (DE); Konrad Meier-Hynek, Herzogenaurach (DE)

(73) Assignee: Areva NP GmbH, Erlangen (DE)

( * ) Notice: Subject to any disclaimer, the term of this patent is extended or adjusted under 35 U.S.C. 154(b) by 274 days.

(21) Appl. No.: 11/396,023

(22) Filed: Mar. 31, 2006

(65) Prior Publication Data

US 2006/0191558 A1 Aug. 31, 2006

Related U.S. Application Data

(63) Continuation of application No. PCT/EP2005/002903, filed on Mar. 18, 2005.

(30) Foreign Application Priority Data

Mar. 24, 2004 (DE) ..... 10 2004 014 822

(51) Int. Cl.
*B08B 3/02* (2006.01)
*B08B 9/02* (2006.01)

(52) U.S. Cl. ..... 134/8; 134/22.12; 451/36; 451/38

(58) Field of Classification Search ..... 134/8, 134/22.1, 22.11, 22.18, 7, 22.12, 24, 168 C, 134/167 C, 169 C, 57 D, 57 DL, 56 D, 58 D, 134/58 DL, 105, 108; 165/95; 34/68, 72, 34/73, 74, 76, 77; 451/36, 37, 38, 39, 40
See application file for complete search history.

(56) References Cited

U.S. PATENT DOCUMENTS

| | | | | |
|---|---|---|---|---|
| 1,748,004 | A * | 2/1930 | Urquhart | 239/401 |
| 2,120,585 | A | 6/1938 | Weelands | |
| 4,051,724 | A * | 10/1977 | Segal et al. | 73/198 |
| 4,124,065 | A * | 11/1978 | Leitner et al. | 165/95 |
| 4,716,611 | A * | 1/1988 | Barry | 15/3.51 |
| 4,856,581 | A | 8/1989 | Santoro | |
| 5,311,929 | A | 5/1994 | Verret | |
| 5,423,917 | A * | 6/1995 | Garcia, Jr. | 134/1 |
| 5,499,639 | A * | 3/1996 | Williams, Jr. | 134/7 |
| 5,685,487 | A | 11/1997 | Ellis | |
| 5,883,512 | A | 3/1999 | Streit et al. | |
| 6,308,774 | B1 | 10/2001 | Krämer et al. | |

FOREIGN PATENT DOCUMENTS

| | | |
|---|---|---|
| DE | 195 46 788 A1 | 6/1997 |
| DE | 198 37 683 A1 | 3/2000 |

(Continued)

*Primary Examiner*—Michael Barr
*Assistant Examiner*—Saeed T Chaudhry
(74) *Attorney, Agent, or Firm*—Laurence A. Greenberg; Werner H. Stemer; Ralph E. Locher

(57) ABSTRACT

A method and device for cleaning pipes of a heat exchanger includes placing a throttle-free jet nozzle against an end of a pipe. The throttle-free jet nozzle has an outlet opening of a same size or slightly smaller than an inner cross-sectional area of the pipe. A stream of air containing an abrasive is blown through the pipe for cleaning the pipe.

10 Claims, 5 Drawing Sheets

FOREIGN PATENT DOCUMENTS

| | | | |
|---|---|---|---|
| EP | 0 357 572 | A1 | 3/1990 |
| EP | 1 391 680 | A1 | 2/2004 |
| JP | 62-162900 | | 7/1987 |
| SU | 24067 | | 11/1931 |
| WO | WO 02/059538 | A1 | 8/2002 |

* cited by examiner

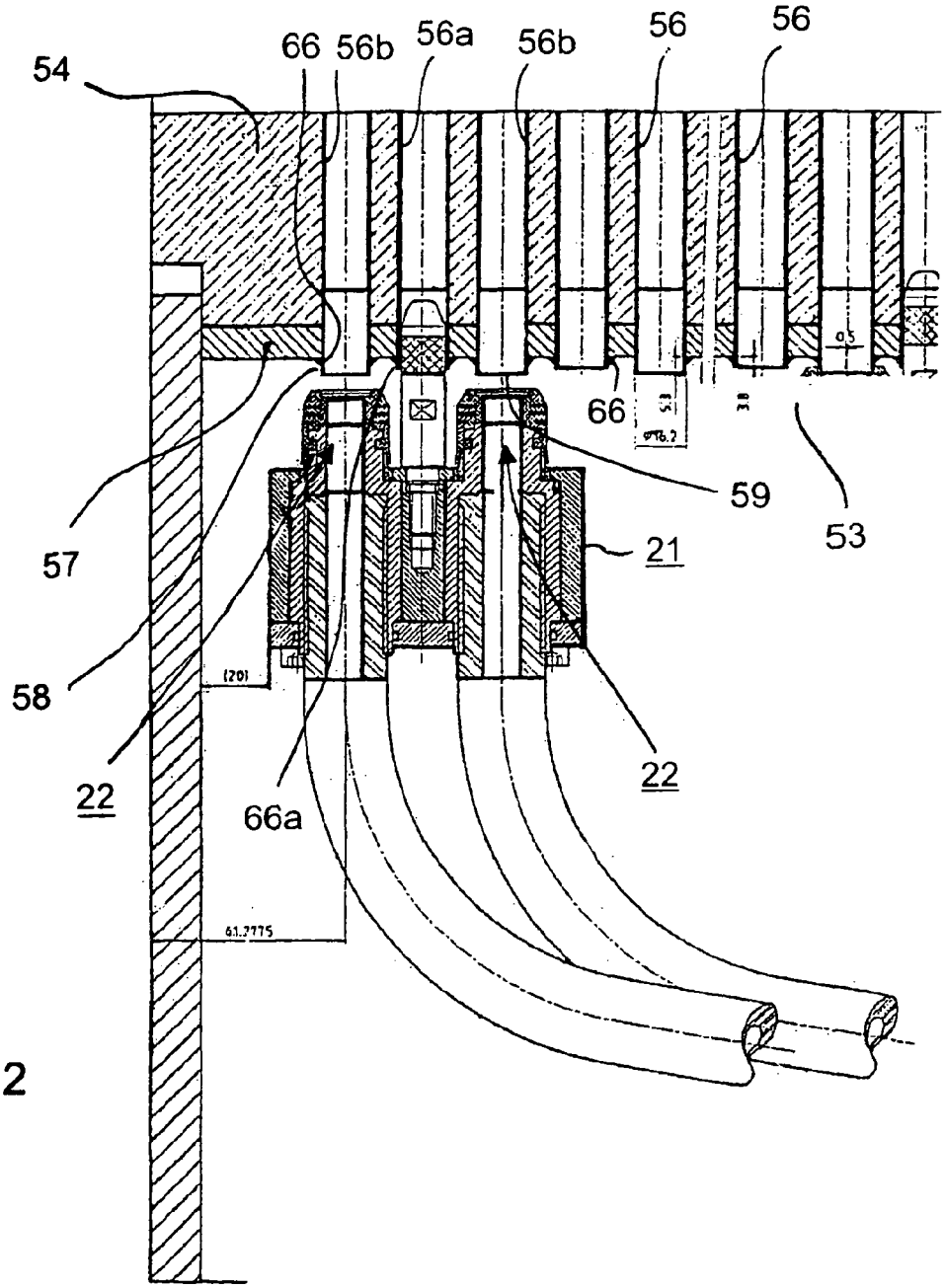
FIG. 2
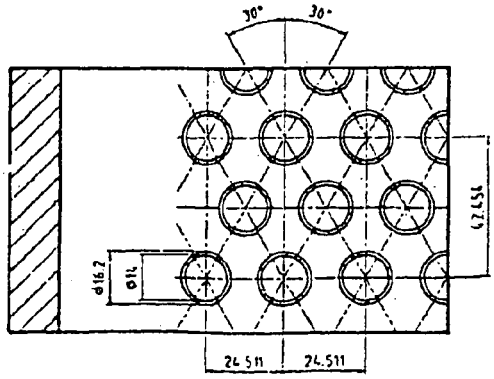

METHOD FOR CLEANING THE PIPES OF A HEAT EXCHANGER BY USE OF AN ABRASIVE AND DEVICE SUITABLE FOR THIS METHOD

CROSS-REFERENCE TO RELATED APPLICATION

This application is a continuation, under 35 U.S.C. §120, of copending international application No. PCT/EP2005/002903, filed Mar. 18, 2005, which designated the United States; this application also claims the priority, under 35 U.S.C. §119, of German patent application No. 10 2004 014 822.8, filed Mar. 24, 2004; the prior applications are herewith incorporated by reference in their entirety.

BACKGROUND OF THE INVENTION

Field of the Invention

The invention relates to a method for cleaning a heat exchanger by use of an abrasive and to a device for carrying out the method. Heat exchanger pipes must be cleaned of deposits from time to time. Although many chemical cleaning methods are available, the large number of heat exchanger pipes and corresponding number of openings mean that this is technically quite a demanding undertaking. Therefore, exchange pipes are primarily cleaned mechanically. Apart from cleaning with brushes, blasting methods are often used, involving an abrasive being blasted through a pipe by use of a jet nozzle placed against an end of a pipe. Such a method is described for example in published, non-prosecuted German patent application DE 195 46 788 A1, corresponding to U.S. Pat. No. 5,883,512. Particles of steel or corundum are used for example as the abrasive. The particles emerging from the other end of the pipe, respectively, are gathered by a collecting device and returned to the circulation of the abrasive. Such a collecting device is described in German patent DE 198 37 683 C2, corresponding to U.S. Pat. No. 6,308,774.

SUMMARY OF THE INVENTION

It is accordingly an object of the invention to provide a method for cleaning the pipes of a heat exchanger by use of an abrasive and a device suitable for performing the method which overcomes the above-mentioned disadvantages of the prior art methods and devices of this general type, with which in particular more efficient cleaning of a heat exchanger is possible.

The object is achieved by a throttle-free jet nozzle being used, preferably one in which the outlet opening is of the same size or slightly smaller than the inner cross-sectional area of the pipe. This configuration makes it possible to subject the pipe that is to be cleaned to a large stream of abrasive. In the case of conventional jet nozzles, this is not possible to the same extent. With the conventional nozzles, the velocity of the stream of abrasive in a feed tube connected to the jet nozzle is greatly increased by a relatively small constriction in a Venturi nozzle. The consequences are that abrasive particles are expelled with high kinetic energy. However, these particles are already retarded within a relatively short piece of pipe. Then only a stream of abrasive with a low particle concentration is available for the pipe cleaning. The situation is different with the invention. Here, because there is no throttling or constriction in the jet nozzle, a stream of abrasive with a very high particle concentration is obtained, accompanied by great abrasiveness. A configuration which allows large outlet openings provides that the jet nozzle is pressed against an end face of an end of a pipe with a contact area encompassing the outlet opening. By contrast with this, in the case of the prior art, a constricted connection piece is introduced into an end of a pipe, the outlet opening of the connection piece having to be reduced at least by an amount corresponding to its wall thickness in comparison with the cross-sectional area of the pipe.

The time spent on performing the cleaning method can be reduced by the number of pipes being cleaned simultaneously. This is accomplished by using a number of jet nozzles which are held on a carrier in the same layout as the pipes of the heat exchanger. While in the case of conventional methods and devices positional fixing of the jet nozzles takes place by inserting them with a narrowed connection piece into an end of a pipe, the invention provides a fixing bolt which protrudes in the blasting direction and, for cleaning, is inserted into an end of a pipe. This is possible without any problem if the fixing bolt is disposed on a carrier at a position corresponding to the layout of the pipes.

A throttle-free jet nozzle is accomplished by the jet nozzle being passed through by a flow channel delimited by an inlet opening and an outlet opening, the flow channel having a cross-sectional area that substantially remains the same and corresponds approximately to the size of the outlet opening. As stated above, the outlet opening of the jet nozzle is encompassed by a contact area which is pressed against the end face of the pipe to be cleaned while the method is being carried out. The contact area is preferably encompassed by a collar disposed radially on the outside and projecting axially. The contact area and the collar thereby form a receptacle for an end of a pipe. This configuration on the one hand makes better sealing of the end region of the pipe possible and on the other hand makes additional positional fixing of the device on the heat exchanger possible. This prevents a carrier carrying a number of jet nozzles from turning about the fixing bolt as an axis of rotation. To increase the sealing between the end of the pipe and the jet nozzle, in a preferred configuration it is provided that the region containing the receptacle and the outlet opening contains an elastomer. This also makes it possible to compensate for tolerances and unevenness in the region of the end face of an end of a pipe. As mechanical protection, and to prevent the collar encompassing the end face region of a pipe from being made to expand by the pressurized stream of abrasive, the collar is enclosed by a stiffening sleeve made of solid material, for example a metal. The elastomer region is preferably formed by an end piece that is in the form of a portion of pipe and is positively connected to the jet nozzle. Other features which are considered as characteristic for the invention are set forth in the appended claims.

Although the invention is illustrated and described herein as embodied in a method for cleaning the pipes of a heat exchanger by use of an abrasive and a device suitable for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a diagrammatic, longitudinal sectional view corresponding to FIG. 1 of a device according to the invention;

DESCRIPTION OF THE PREFERRED EMBODIMENTS

Figure 1:
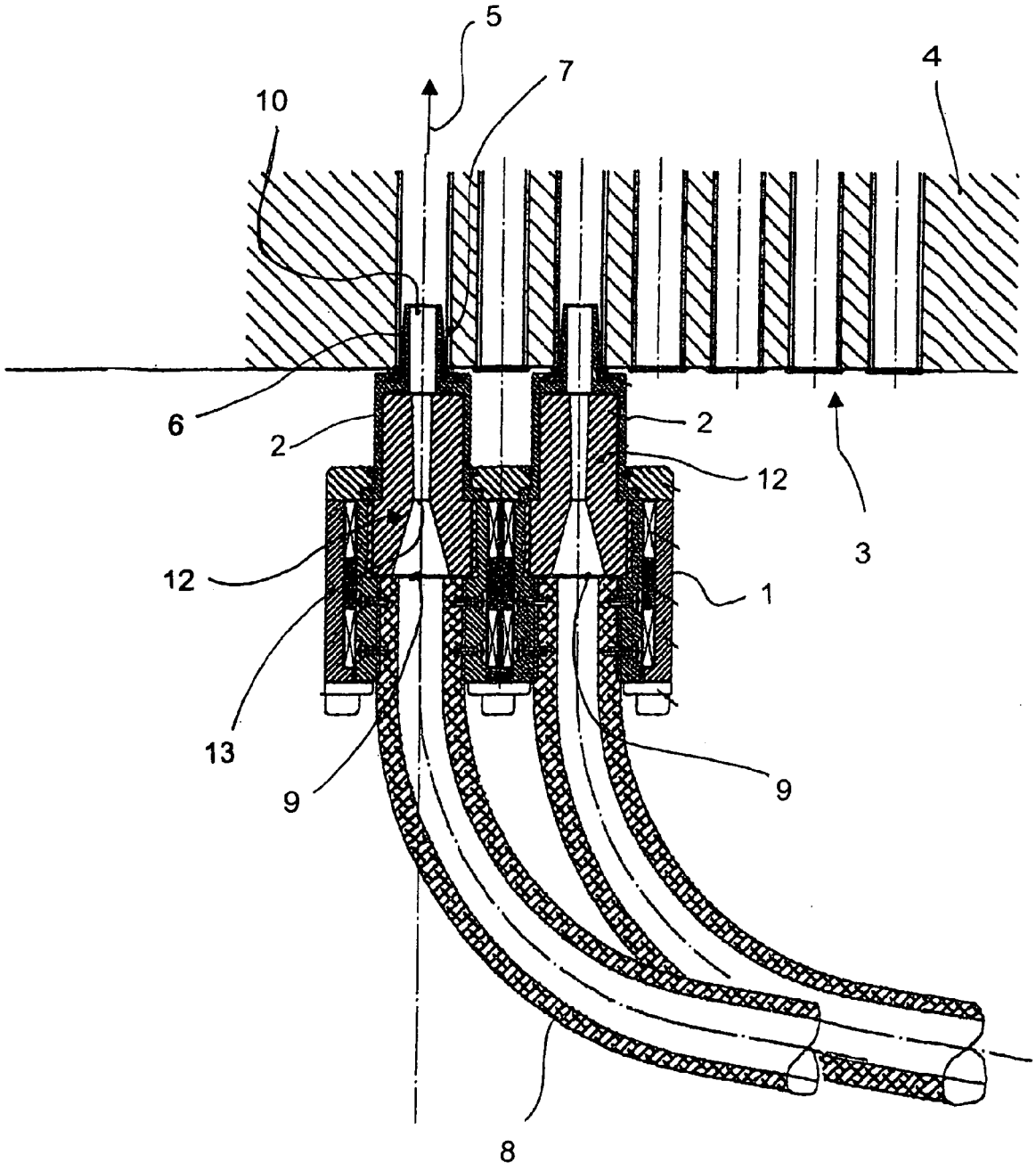
FIG. 1 PRIOR ART
FIG. 1 is a diagrammatic, longitudinal sectional view of a conventional device, positioned on a heat exchanger.

Referring now to the figures of the drawing in detail and first, particularly, to FIG. 1 thereof, there is shown a conventional device for performing a conventional cleaning method for providing background information for understanding the invention. Two jet nozzles 2 fixed to a carrier 1 are placed for example against an inlet side 3 of a heat exchanger 4. The jet nozzles 2 are made narrower at their end pointing in the blasting direction 5, to form a cylindrical connection piece 6, which is inserted into the end of the pipe 7. At its end pointing counter to the blasting direction 5, the jet nozzles 2 bear an inlet opening 9, connected to a feed tube 8. Disposed between the outlet opening 10, which is enclosed by the front end of the connection piece 6, and the inlet opening 9 is a Venturi nozzle 12 with a throttling point 13.

Figure 3:
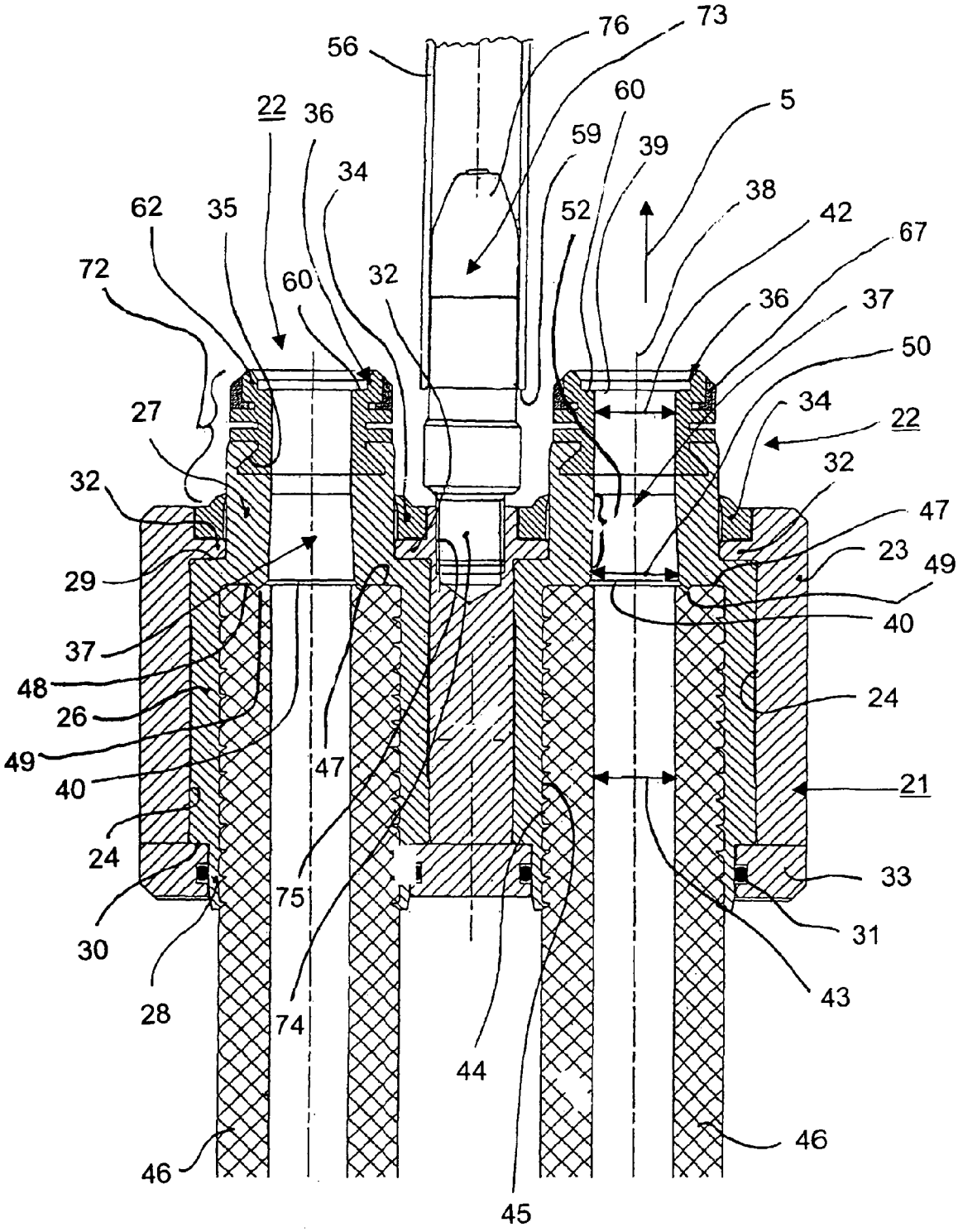
FIG. 3 is an enlarged diagrammatic, longitudinal sectional view of a detail shown in FIG. 2.
Figure 4:
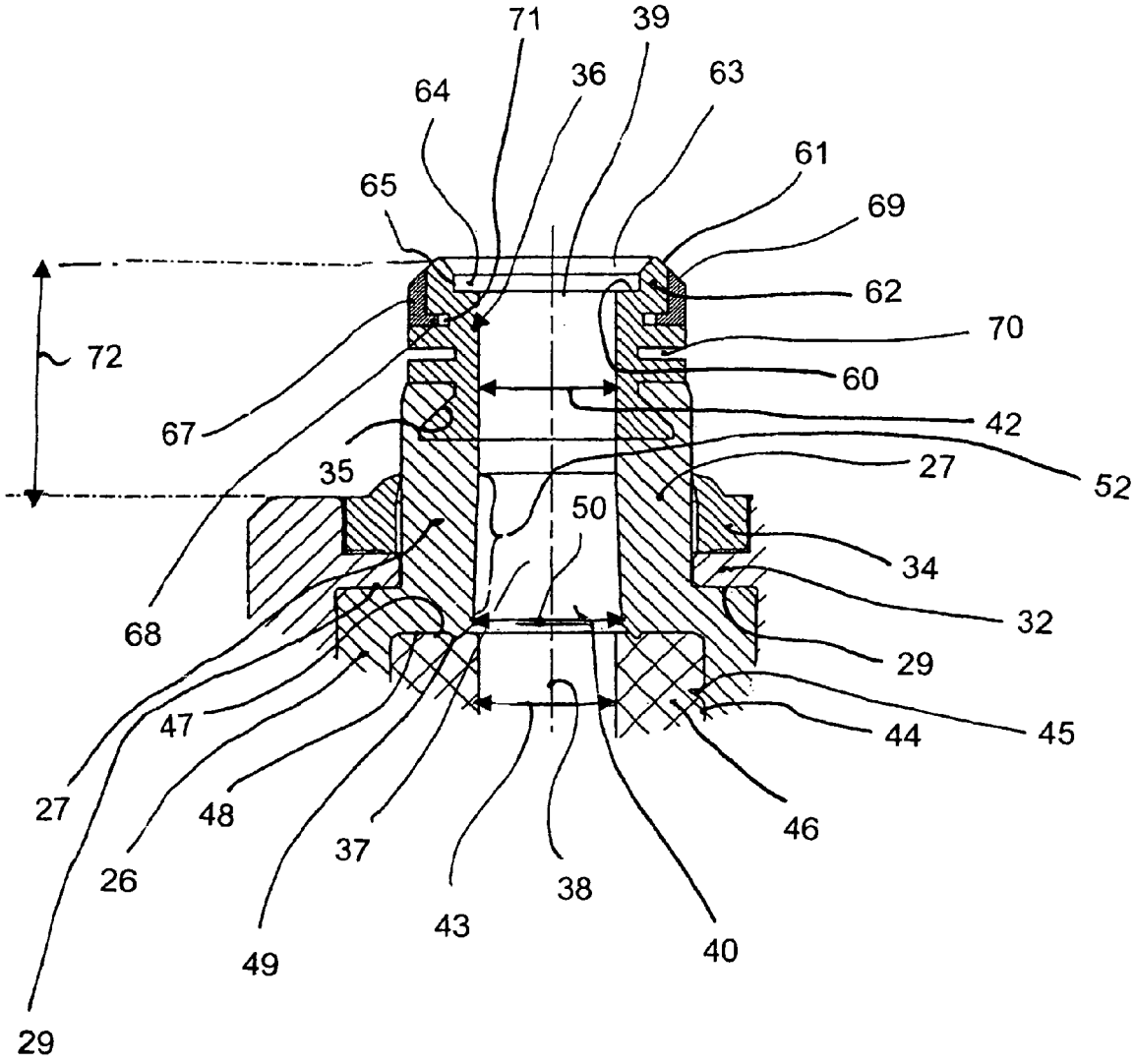
FIG. 4 is an enlarged diagrammatic, longitudinal sectional view of a detail shown in FIG. 2.

Turning now to the invention of the application, FIGS. 2-5 show a jet head with a carrier 21, in which two jet nozzles 22 are mounted. Of course, jet heads with only one jet nozzle or more than two jet nozzles are also conceivable. The carrier 21 is substantially formed by a hollow-cuboidal housing 23 (FIG. 3). The housing 23 is passed through by two bores 24, which run parallel to each other and each receive a jet nozzle 22. The jet nozzle 22 is substantially configured as a housing 25 in the form of a portion of pipe. The housing 25 has three different longitudinal portions, a middle portion 26 having a larger diameter than the two other portions, that is a front portion 27 and a rear portion 28. The transition between the middle portion 26 and the narrowed portions 27, 28 is in each case formed by a radial shoulder 29, 30. A stop flange 32 protrudes radially inward in each case from the wall of the bores 24. The side of the stop flange 32 that faces the middle portion 26 interacts with the radial shoulder 29 in the sense of an axial fixing of the housing 25.

With the radial shoulder 30, the housing 25 bears against a cover part 33, which closes the carrier housing 23 on the rear side. Disposed between the cover part 33 and the rear portion 28 of the jet nozzle 22 is an O-ring seal 31. Inserted in the region of the bore 24 extending away from the stop flange 32 and enclosing the portion 27 is an elastomer seal 34, encompassing the circumference of the portion 27. Made in the front end face of the jet nozzle housing 25 is a cross-sectionally dovetailed groove 35, in which an end piece 36 made of elastomer material substantially in the form of a portion of pipe is form fitted with its one end. A form-fitting or locking connection is one that connects two elements together due to the shape of the elements themselves, as opposed to a force-locking connection, which locks the elements together by force external to the elements.

The front portion 27 is passed through by a flow channel 37. A center longitudinal axis 38 of the flow channel 37 at the same time forms the center longitudinal axis of the jet nozzle housing 25. The flow channel 37 is delimited on the front side by an outlet opening 39 and at its other end by an inlet opening 40. It has substantially a cross-sectional area that remains the same or a diameter 42 that remains the same. The cross-sectional area or the diameter 42 corresponds to the cross-sectional area or a diameter 43 of a feed tube 46 screwed with an external thread 44 into an internal thread 45 of the middle portion 26. The feed tube 46 bears with its front end face 47 against a radial shoulder 48 that is present in the transitional region between the portion 26 and the portion 27. Protruding from the radial shoulder 48 in the axial direction is a cross-sectionally wedge-shaped projection 49, which encompasses the inlet opening 40 in an annular manner and digs itself into the material of the feed tube 46, an elastomer material. This improves the sealing between the feed tube 46 and the housing portion 26. A diameter 50 of the inlet opening 40 is slightly greater than the diameter 43 of the feed tube 46. The difference in diameter is in this case made for example to correspond to an expansion of the diameter 43 when the tube is subjected to a pressurized stream of abrasive. This ensures that a stream of abrasive does not impinge on an interfering housing edge protruding into the flow channel 37. A region 52 of the flow channel 37 adjoining the inlet opening 40 is made to narrow slightly conically, approximately as far as its middle, the region 52 being adjoined by a cylindrical channel region with the diameter 42.

To carry out a cleaning method, as shown in FIG. 2, the carrier 21 is disposed on an inlet side 53 or the outlet side of a heat exchanger 54. If the heat exchanger 54 is a nuclear power plant, the carrier 21 is generally held by a non-illustrated manipulator, on which the carrier 21 is fixed by a fastening device 55 (see FIG. 5). Pipes 56 of the heat exchanger 54 are disposed in a regular layout and pass with their ends through a holding plate 57. They protrude from the latter with an overhang 58. The jet nozzles 22 are disposed spaced apart from one another on the carrier 21 to the extent that they can be placed on end faces 59 of two pipes **56*b* separated from each other by a pipe 56*a*. For this purpose, the end piece 36 has a stop area 60, which interacts with the end face 59 and encompasses the outlet opening 39. The stop area 60 extends transversely in relation to the center longitudinal axis 38. The stop area 60 is in turn enclosed by a collar 62, which protrudes in the axial direction of the blasting direction or in the blasting direction 5. The collar 62 is formed in a cross-sectionally wedge-shaped manner, having a radially inwardly directed sloping area 63 and a radially outwardly directed sloping area 61. The sloping area 63 serves as a guiding-in slope when the jet nozzle 22 is placed on an end of a pipe. During the cleaning, the latter lies in a recess 64 enclosed by the stop area 60 and the collar 62. The collar 62 thereby bears with a cylindrical edge portion 65 against the outer circumference of the pipe 56*b*. The sloping area 63 bears snugly against a weld 66, with which the pipes 56 are fixed on the holding plate 57. The collar 62 consequently acts like a sealing lip which interacts with the outer circumference and the weld 66 of the pipe 56*b*. In order that the collar cannot radially expand when it is subjected to pressure, it is encompassed around its full circumference by a stiffening sleeve 67. The stiffening sleeve 67 lies with a flange 68, protruding radially inward from its end facing the carrier 21, in a radial groove 71 of the end piece 36. The end face of the stiffening sleeve 67 that is facing the flange 68 is beveled and forms a sloping area 69 in line with the sloping area 61 of the collar 62. The beveling of the end piece in the form of the sloping areas 61 and 69 prevents it from coming into contact with a weld 66***a* of a neighboring pipe 56*a* and under some circumstances thereby preventing a sealing abutment of an end piece 3 against the pipe 56*b* that is to be cleaned. Between the portion 27 of the jet nozzle housing 25 and the stiffening sleeve 67 there is in the end piece 36 a further radial groove 70, which increases its elasticity in the axial direction.

Figure 5:
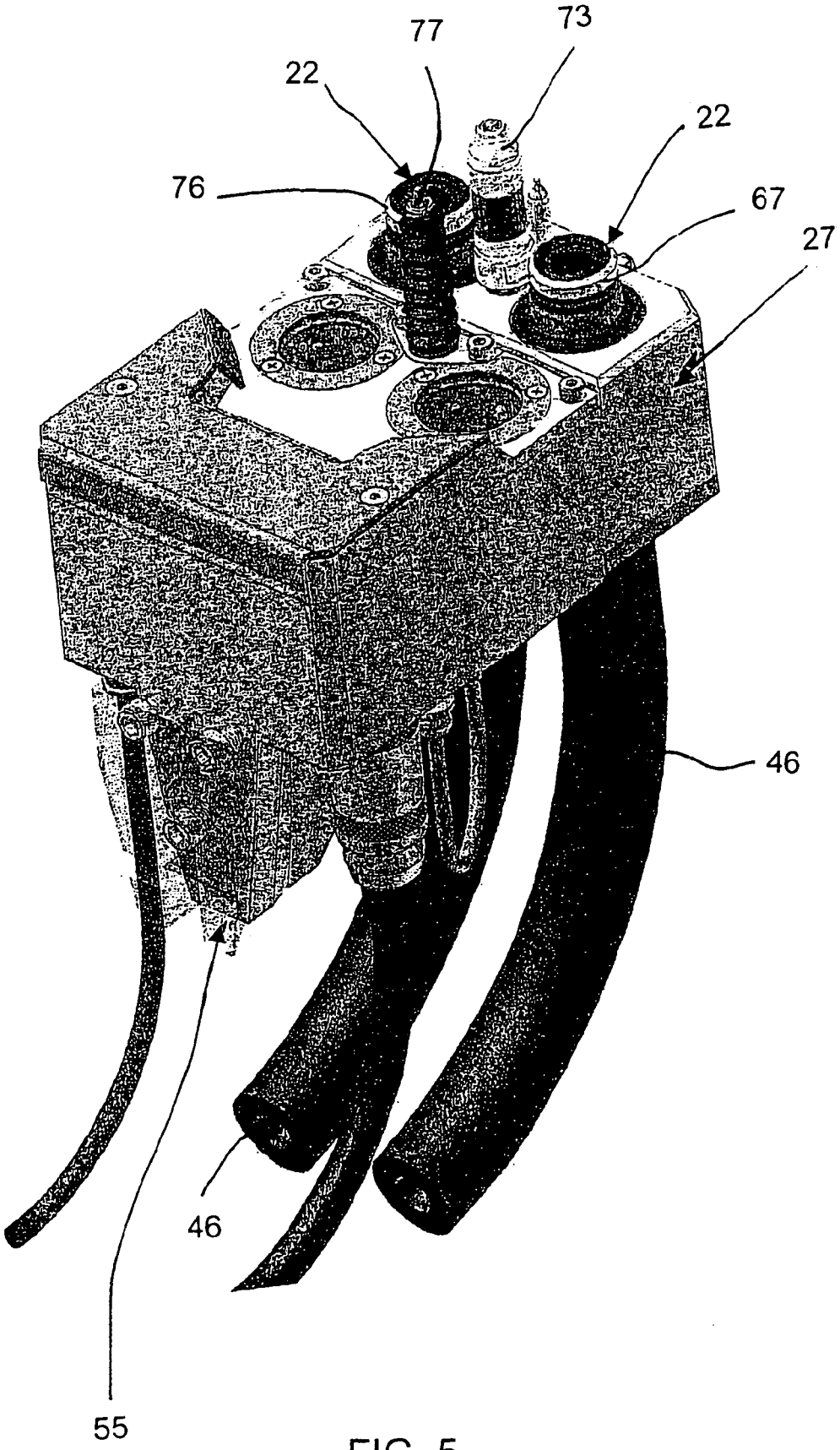
FIG. 5 is a diagrammatic, perspective view of the device shown in FIG. 2.

For the positional fixing of the carrier 21 on the holding plate 57, there is on the front side of the carrier 21 from which the jet nozzles 22 also protrude with an overhang 72 a fixing bolt 73, which protrudes from the carrier 21 in the direction of the center longitudinal axis 38 (FIG. 5). The fixing bolt 73 is screwed with a threaded portion 74 into a threaded bore 75 of the carrier 21 (FIG. 3). Its front end 76, facing away from the threaded portion 74, is conically narrowed. The longitudinal portion adjoining the narrowed region has a diameter which is slightly smaller than the inside diameter of the pipe 56. During the cleaning operation, the fixing bolt 73, 76 protrudes into the pipe 56*a* disposed between two pipes 56*b* that are to be cleaned. Turning of the carrier about the fixing bolt 73 as an axis of rotation is prevented by the positively engaging interaction of the pipe ends with the end pieces 36.

Also disposed on the front side of the carrier 21 is a mechanical distance sensor 77 (FIG. 5). This ensures that the carrier 21 can be moved into a predetermined position in relation to the holding plate 57 by the non-illustrated manipulator.

We claim:

1. A method for cleaning pipes of a heat exchanger, which comprises the steps of:

providing a throttle-free jet nozzle having an outlet opening of a same size or smaller than an inner cross-sectional area of a pipe of the heat exchanger and a contact area encompassing the outlet opening;

placing the throttle-free nozzle against an end of the pipe of the heat exchanger by pressing the contact area against the end face of the end of the pipe of the heat exchanger such that there is no substantial throttling or constriction in the jet nozzle, wherein the nozzle is not insertable in the pipe; and blowing a pressurized air mixture through the pipe of the heat exchanger.

2. The method according to claim 1, which further comprises:

cleaning a plurality number of the pipes simultaneously, by a plurality number of throttle-free jet nozzles held on a carrier in a same layout the same as the pipes of the heat exchanger and being placed against corresponding pipes.

3. The method according to claim 2, which further comprises:

arresting the carrier on the end of the pipe; and introducing a fixing bolt protruding from the carrier in a blasting direction into the end of the pipe.

4. A method for cleaning heat exchanger tubes using a pressurized air mixture delivered from a supply line, the pressurized air mixture containing an abrasive, the method comprising:

providing at least one blasting nozzle, the at least one blasting nozzle having:

a nozzle body having an outer surface, a first end, an opposed second end and a channel extending therethrough between the first and second ends; the first end of the nozzle body having an inlet opening for receiving therethrough the pressurized air mixture from the supply line; the second end of the nozzle body having an outlet opening therein through which the pressurized air mixture exits the nozzle body;

the channel having a first diameter at the inlet opening and a second diameter at the outlet opening, the second diameter being sized to correspond substantially to the internal diameter of the heat exchanger tube, the first diameter being sized at least as large as the second diameter;

the nozzle body further having at the second end thereof a third diameter defined by the outer surface, the third diameter being at least as large as the internal diameter of the heat exchanger tube connecting the first end of the nozzle body of the at least one blasting nozzle to the end of the supply line, wherein the nozzle body is not insertable in the heat exchanger tube;

coupling the second end of the nozzle body of the at least one blasting nozzle to the end of the heat exchanger tube to be cleaned; and directing the flow of the pressurized air mixture from the supply line through the at least one blasting nozzle and into the heat exchanger tube to be cleaned such that there is no substantial throttling or constriction in the jet nozzle.

5. The method of claim 4 wherein:

the at least one blasting nozzle includes a first blasting nozzle and a second blasting nozzle;

the connecting step includes connecting the first end of the nozzle body of each blasting nozzle to the end of a corresponding supply line;

the coupling step includes coupling the second end of the nozzle body of each blasting nozzle to an end of a corresponding heat exchanger tube to be cleaned; and the directing step includes simultaneously urging the flow of the pressurized air mixture from the respective supply line through each of the first and second blasting nozzles and into respective heat exchanger tubes to be cleaned.

6. The method of claim 4 wherein the coupling step further includes forming a seal between the second end of the nozzle body of the at least one blasting nozzle and the heat exchanger tube to be cleaned.

7. The method of claim 6 wherein:

the at least one blasting nozzle has a contact surface formed on the nozzle body and surrounding the outlet opening, the contact surface is in a plane, the plane is perpendicular to a longitudinal axis of the nozzle body; and the seal forming step includes abutting the contact surface of the nozzle body against an end face of the heat exchanger tube to be cleaned.

8. The method of claim 7 wherein:

the at least one blasting nozzle further includes a collar projecting longitudinally away from the second end of the nozzle body and extending radially along an outer edge of the contact surface; and the seal forming step further includes abutting a portion of an inner periphery of the collar against an outer periphery of the end of the heat exchanger tube to be cleaned.

9. The method of claim 8 further comprising locating the at least one blasting nozzle in position relative to the heat exchanger tube to be cleaned prior to coupling.

10. The method of claim 9 further including:

providing a carrier holding the at least one blasting nozzle;

the carrier having a front portion, a rear portion and at least one bore defined in the carrier, the at least one bore extending between the front and rear portions of the carrier, the at least one bore being configured to receive therethrough the at least one blasting nozzle, the front portion having a pin extending forwardly therefrom; and the locating step includes inserting the pin into one of the heat exchanger tubes adjacent the heat exchanger tube to be cleaned.

* * * * *